US009302288B2

(12) United States Patent
Waterston

(10) Patent No.: US 9,302,288 B2
(45) Date of Patent: Apr. 5, 2016

(54) DOOR PAINTING ASSEMBLY

(71) Applicant: Steve Waterston, Hamilton (CA)

(72) Inventor: Steve Waterston, Hamilton (CA)

( * ) Notice: Subject to any disclaimer, the term of this patent is extended or adjusted under 35 U.S.C. 154(b) by 87 days.

(21) Appl. No.: 14/242,991

(22) Filed: Apr. 2, 2014

(65) Prior Publication Data

US 2015/0283574 A1 Oct. 8, 2015

(51) Int. Cl.
*B05C 13/02* (2006.01)
*B25H 1/06* (2006.01)

(52) U.S. Cl.
CPC . *B05C 13/02* (2013.01); *B25H 1/06* (2013.01)

(58) Field of Classification Search
CPC ..... B05B 13/0285; B05B 13/0228; Y10S 269/905; B25H 1/06; F16M 11/10; F16M 11/105; B05C 13/02
USPC ..... 403/94, 124, 114
See application file for complete search history.

(56) References Cited

U.S. PATENT DOCUMENTS 1,581,960 A 4/1926 King
3,048,387 A * 8/1962 Waggoner ..... B25H 1/0007 269/51
4,491,308 A * 1/1985 Walton ..... B23Q 3/10 269/296
4,577,843 A * 3/1986 Milwain ..... B25H 5/00 269/296
5,076,796 A * 12/1991 Kusayanagi ..... H01R 9/091 439/83
5,090,648 A 2/1992 Wood, IV
5,164,011 A 11/1992 Ray
5,551,980 A 9/1996 Turnbo
D399,111 S 10/1998 Budesa
5,894,945 A * 4/1999 Curran ..... B25B 11/00 211/162
6,090,204 A * 7/2000 Speed ..... B05B 13/0285 118/500
6,338,758 B1 1/2002 Curran
6,561,470 B1 * 5/2003 Gottfredson ..... B05B 13/0228 248/130
6,702,130 B1 * 3/2004 Carlilse ..... B05B 13/0285 118/500
7,320,555 B2 * 1/2008 Chang ..... F16C 11/106 248/288.31
7,481,323 B2 1/2009 Fisher
7,870,834 B1 * 1/2011 Cundiff ..... B05B 13/0285 118/500
8,066,267 B2 * 11/2011 Schaerer ..... B05B 13/0285 248/130
2010/0101926 A1 * 4/2010 Wang ..... H01H 3/022 200/506
2011/0229254 A1 * 9/2011 Su ..... F16D 3/2052 403/114

* cited by examiner

*Primary Examiner* — Lee D Wilson
*Assistant Examiner* — Henry Hong

(57) ABSTRACT

A door painting assembly for mounting the door to a support such that the door may be rotated to facilitate painting the door includes a mount operationally coupled to a door. The mount comprises a rod operationally coupled to the door. The rod extends laterally away from the door. An outer surface of the rod has a concavely arcuate area. A pair of brackets is each coupled to the rod. Each of the pair of brackets is coupled to the door so the rod is retained on the door. A rest is operationally coupled to a supporting structure. The concavely arcuate area of the rod engages the rest. The door is supported above a support surface at a height is accessible to a user. The door is rotatable so the user may easily paint each side of the door.

16 Claims, 6 Drawing Sheets

DOOR PAINTING ASSEMBLY

BACKGROUND OF THE DISCLOSURE

Field of the Disclosure

The disclosure relates to door painting devices and more particularly pertains to a new door painting device for mounting the door to a support such that the door may be rotated to facilitate painting the door.

SUMMARY OF THE DISCLOSURE

An embodiment of the disclosure meets the needs presented above by generally comprising a mount operationally coupled to a door. The mount comprises a rod operationally coupled to the door. The rod extends laterally away from the door. An outer surface of the rod has a concavely arcuate area. A pair of brackets is each coupled to the rod. Each of the pair of brackets is coupled to the door so the rod is retained on the door. A rest is operationally coupled to a supporting structure. The concavely arcuate area of the rod engages the rest. The door is supported above a support surface at a height is accessible to a user. The door is rotatable so the user may easily paint each side of the door.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
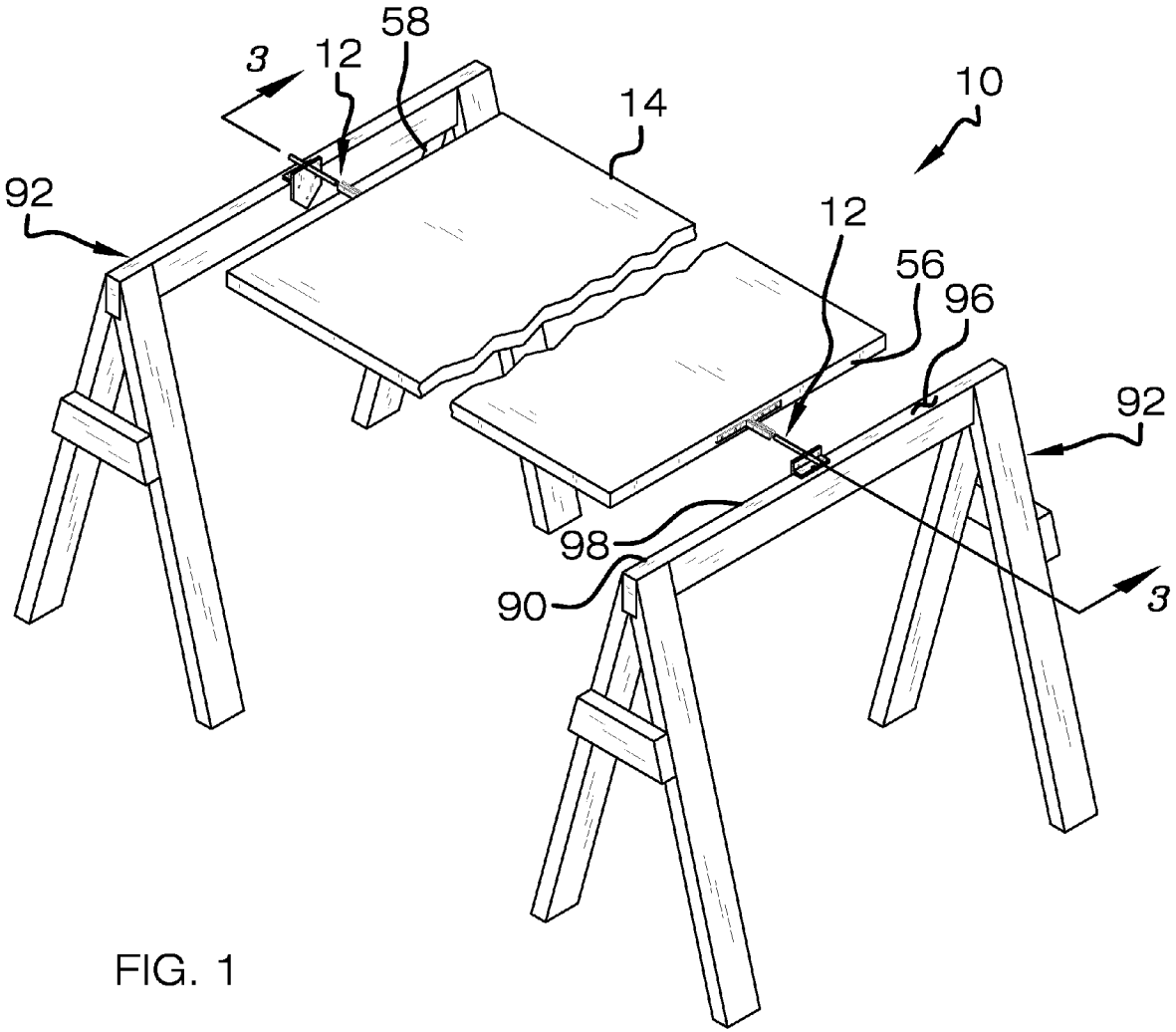
FIG. 1 is an in-use view of a door painting assembly according to an embodiment of the disclosure.
Figure 2:
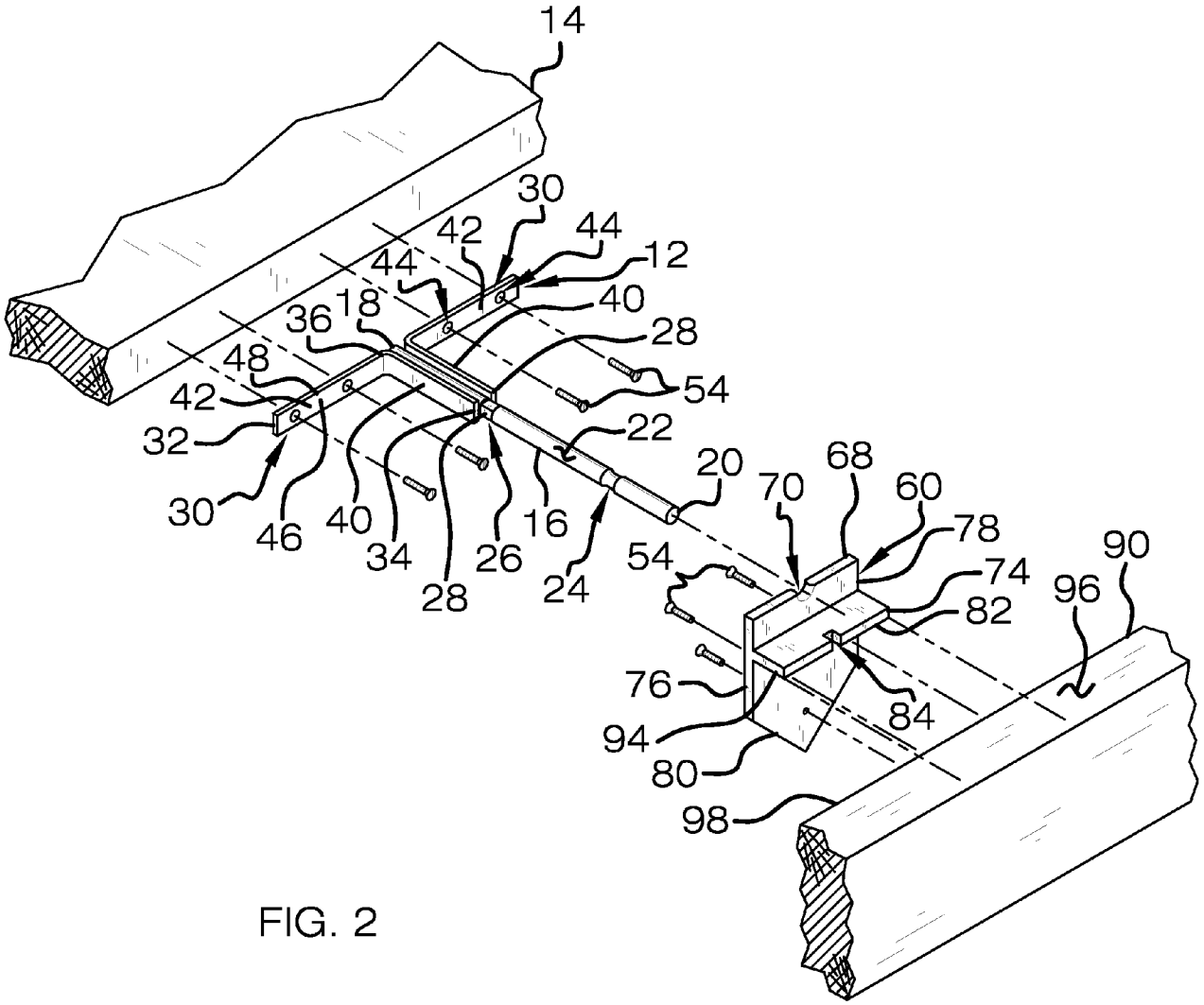
FIG. 2 is an exploded perspective view of an embodiment of the disclosure.
Figure 3:
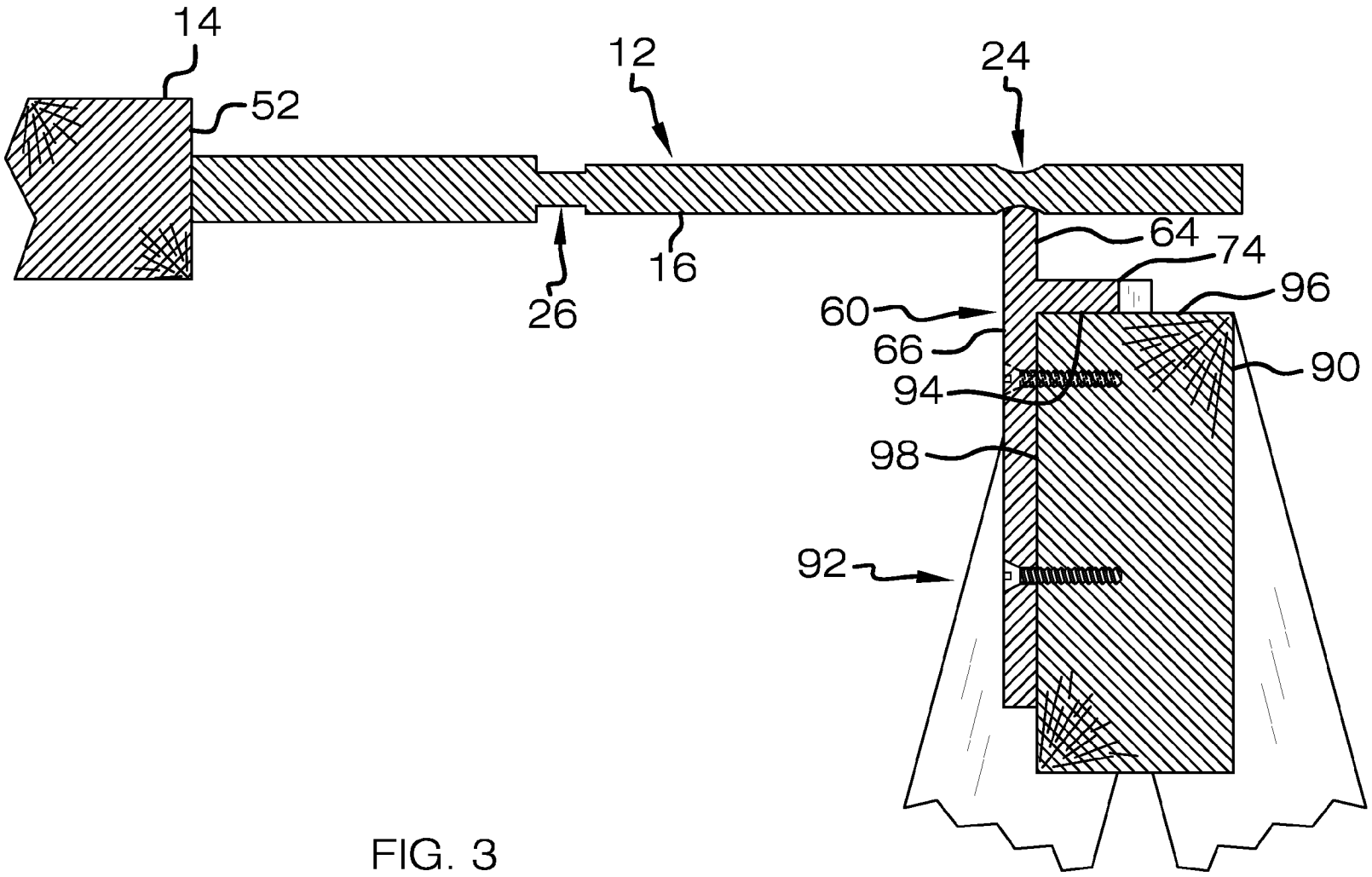
FIG. 3 is a cross sectional view taken along line 3-3 if FIG. 1 of an embodiment of the disclosure.
Figure 4:
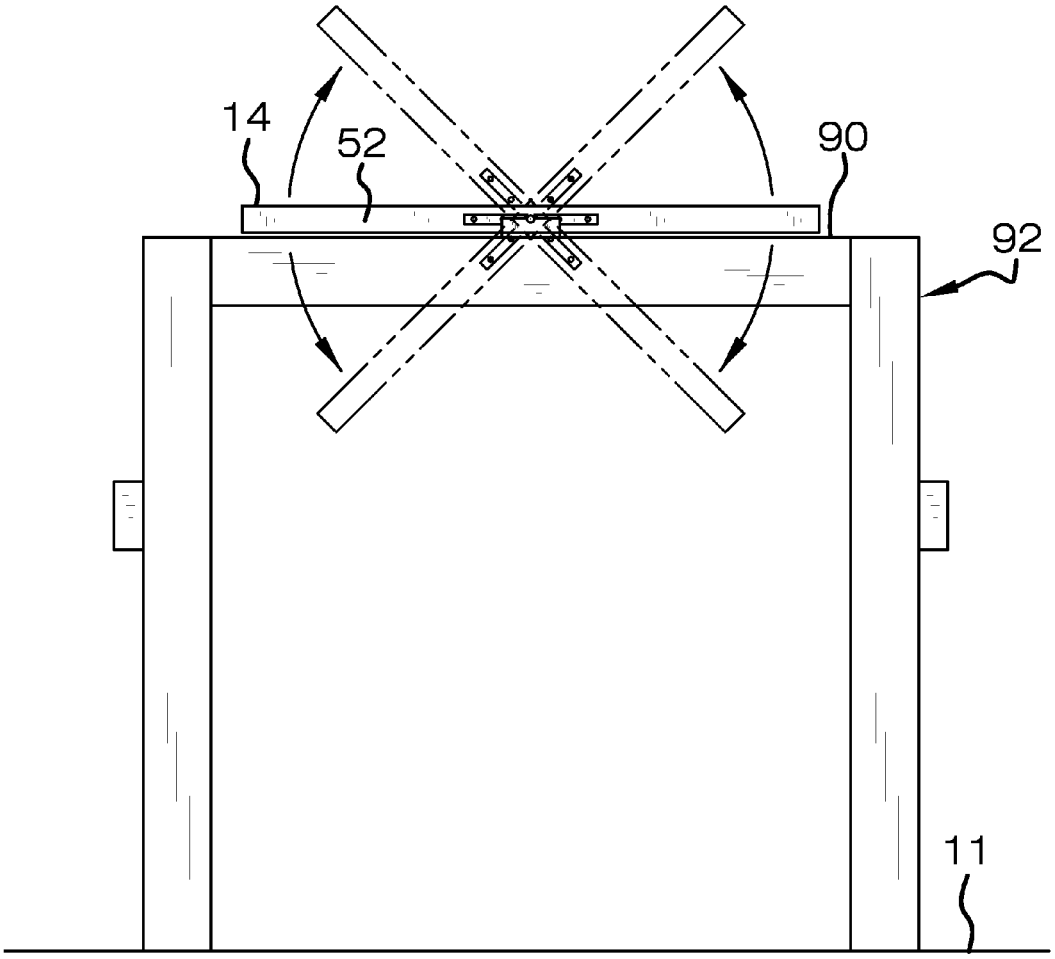
FIG. 4 is a front view of an embodiment of the disclosure.
Figure 5:
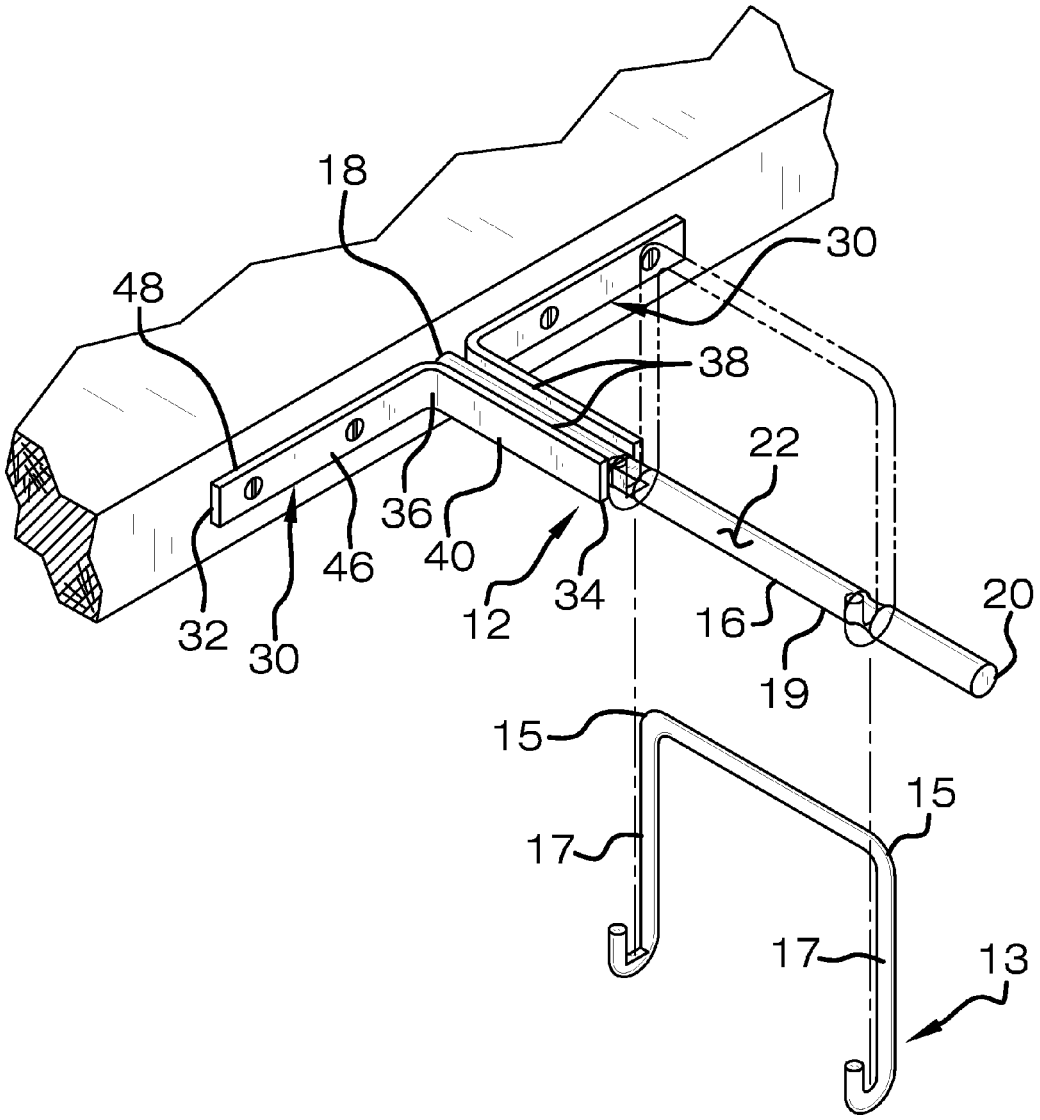
FIG. 5 is a top perspective view of an embodiment of the disclosure.
Figure 6:
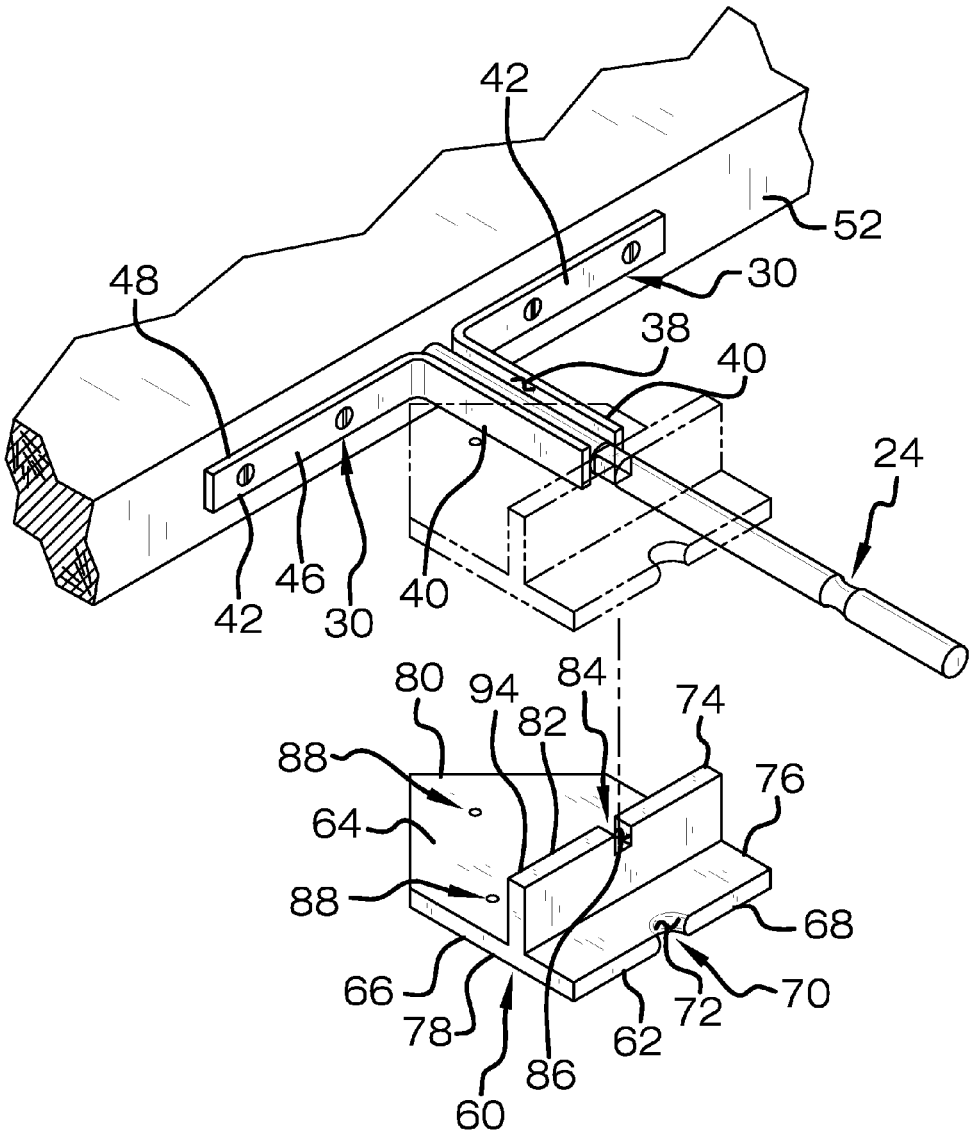
FIG. 6 is a perspective view of an embodiment of the disclosure being positioned on a support surface.

With reference now to the drawings, and in particular to FIGS. 1 through 6 thereof, a new door painting device embodying the principles and concepts of an embodiment of the disclosure and generally designated by the reference numeral 10 will be described.

As best illustrated in FIGS. 1 through 6, the door painting assembly 10 generally comprises a mount 12 operationally coupled to a door 14. The door 14 may be a man door of any conventional design. The mount 12 comprises a rod 16 that has a first end 18 and a second end 20. The rod 16 is elongated between the first 18 and second 20 ends and may have a length between 16 cm and 22 cm.

An outer surface 22 of the rod 16 has a concavely arcuate area 24. The concavely arcuate area 24 of the rod 16 is positioned proximate the second end 20 of the rod 16. Moreover, the outer surface 22 of the rod 16 has a square area 26. Each of four sides 28 of the square area 26 are recessed inwardly from the outer surface 22 of the rod 16. The square area 26 of the rod 16 is positioned proximate the first end 18 of the rod 16. The rod 16 may have a diameter between 6 mm and 12 mm.

A pair of brackets 30 each has a primary end 32 and a secondary end 34. Each of the pair of brackets 30 is elongated between the primary 32 and secondary 34 ends. The pair of brackets 30 each has a bend 36 thereon so each of the pair of brackets 30 is L-shaped. An outside surface 38 of a coupled portion 40 of the pair of brackets 30 each is coupled to opposite sides of the outer surface 22 of the rod 16. The pair of brackets 30 may be welded to the rod 16.

The bend 36 on each of the pair of brackets 30 is positioned adjacent to the first end 18 of the rod 16. An engaging portion 42 of each of the pair of brackets 30 extends laterally away from the rod 16. The engaging portion 42 of each of the pair of brackets 30 has a pair of fastener apertures 44 extending through a front side 46 and a back side 48 of the engaging portion 42 of each of the pair of brackets 30. Each of the engaging 42 and the coupled 40 portions of the pair of brackets 30 may have a length between 6 cm and 10 cm.

The mount 12 is positionable on the door 14 so the back side 48 of the engaging portion 42 of the pair of brackets 30 coextensively abuts an end 52 of the door 14. A plurality of fasteners 54 is extendable through the fastener apertures 44 in the pair of brackets 30. The plurality of fasteners 54 engages the door 14 so the mount 12 is retained on the door 14 with the rod 16 extending laterally away from the door 14. The fasteners 54 may be wood screws of any conventional design. The mount 12 is one of a pair of the mounts 12. Each of the pair of mounts 12 is coupled to an associated one of a top end 56 and a bottom end 58 of the door 14. The pair of mounts 12 is each centrally positioned on the door 14.

A rest 60 is provided. The rest 60 has an outermost edge 62 extending between a front side 64 and a back side 66 of the rest 60. A top side 68 of the outermost edge 62 of the rest 60 has a first groove 70 extending downwardly thereon. A bounding surface 72 of the first groove 70 defines a semicircular shape. The first groove 70 is centrally positioned on the top side 68 of the outermost edge 62 of the rest 60. Finally, the first groove 70 may have a radius between 3 mm and 6 mm.

A retainer 74 is coupled to and extends forwardly from the front side 64 of the rest 60. The retainer 74 extends between a first lateral side 76 and a second lateral side 78 of the outermost edge 62 of the rest 60. Moreover, the retainer 74 is positioned closer to the top side 68 and a bottom side 80 of the outermost edge 62 of the rest 60. The retainer 74 may be positioned away from the top side 68 of the outermost edge 62 of the rest 60 a distance between 2 cm and 4 cm.

A forward edge 82 of the retainer 74 has a second groove 84 extending rearwardly thereon. A defining surface 86 of the second groove 84 defines a square shape. The second groove 84 is centrally positioned on the forward edge 82 of the retainer 74. The second groove 84 has a width and a depth that is similar to a width of the square area 26 of the rod 16.

The bottom side 80 of the outermost edge 62 of the rest 60 tapers to a point. The rest 60 has a plurality of fastener openings 88. The plurality of fastener openings 88 extends through the front side 64 and the back side 66 of the rest 60. Moreover, the plurality of fastener openings 88 are arranged in a triangular shape on the rest 60.

The rest 60 is one of a pair of the rests 60. Each of the pair of rests 60 is removably coupled to a topmost arm 90 of an associated one of a pair of supporting structures 92. A bottom surface 94 of the retainer 74 on each of the pair of rests 60 abuts an uppermost surface 96 of the topmost arm 90 of the associated one of the pair of supporting structures 92. The front side 64 of the pair or rests 60 abuts a forward side 98 of the topmost arm 90 of the associated one of the pair of supporting structures 92.

A plurality of fasteners 54 extends through each of the plurality of fastener openings 88 in the rest 60. The plurality of fasteners 54 engages the forward side 98 of the topmost arm 90 of the associated one of the pair of supporting structures 92. Additionally, the plurality of fasteners 54 retains the pair of rests 60 on the associated one of the pair of supporting structures 92. The top side 68 of the outermost edge 62 of the pair of rests 60 each is positioned upwardly from the topmost arm 90 of the associated one of the pair of supporting structures 92. Finally, each of the pair of supporting structures 92 may be a saw horse of any conventional design.

The pair of supporting structures 92 is spaced apart. The door 14 is positionable between the pair of supporting structures 92 so the concavely arcuate area 24 on each of the pair rods 16 engages the first groove 70 in each of the pair of rests 60. The door 14 is rotatably coupled between the pair of supporting structures 92. Moreover, the door 14 is supported above a support surface 11 at a height that is accessible to a user. The door 14 is rotatable so the user may easily paint the door 14. The support surface 11 may be ground.

A carrying member 13 is provided. The carrying member 13 has a pair of spaced bends 15 positioned thereon. The pair of spaced bends 15 define a pair of longitudinal arms 17 of the carrying member 13 extending downwardly from a lateral arm 25 of the carrying member 13. Moreover, the carrying member 13 has a U-shape.

A bottom end 19 of each of the pair of longitudinal arms 17 of the carrying member 13 is bent upwardly. Each of the pair of longitudinal arms 17 of the carrying member 13 has a J-shape. An upper side 21 of the bend 15 on a first one of the pair of longitudinal arms 23 of the carrying member 13 is flattened. The lateral arm 13 of the carrying member 13 may be gripped by the user.

The carrying member 13 is one of a pair of the carrying members 13. The bend 15 on each of the pair of longitudinal arms 17 of the pair of carrying members 13 each engages an associated one of the pair of rods 16. The square area 26 on each of the pair of rods 16 engages the flattened upper side 21 of the bend 15 on the first longitudinal arm 23 of the pair of carrying members 13. Moreover, the pair of carrying members 13 is used to carry the door 14 after the door 14 has been painted.

In use, the door 14 is painted after the door 14 is rotatably coupled between the pair of support structures 92. The user rotates the door 14 to selectively paint both sides of the door 14. After the door 14 is painted, each of the pair of rests 60 is removed from the pair of support structures 92. The pair of rests 60 are positioned on the support surface 11 so back side 66 of the pair of rests 60 abuts the support surface 11. The retainer 74 extends upwardly from the pair of rests 60.

The door 14 is positioned between the pair of rests 60 so the square area 26 of each of the pair of rods 16 engages the second groove 84 in the retainer 74 on each of the pair of rests 60. Additionally, the door 14 is oriented parallel with the support surface 11. The second groove 84 in the retainer 74 on each of the pair of rests 60 prevents to door 14 from rotating in the pair of rests 60. The door 14 is left on the pair of rests 60 so the paint on the door 14 may dry.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A door painting assembly for rotatably mounting the door to a support, said assembly comprising:

a mount coupled to the door, said mount comprising;

a rod coupled to the door such that said rod extends laterally away from the door, an outer surface of said rod having a concavely arcuate area, said rod having a square area spaced from said concavely arcuate area;

a pair of brackets each coupled to said rod, each of said pair of brackets being coupled to the door such that said rod is retained on the door;

a rest operationally coupled to a supporting structure, said concavely arcuate area of said rod engaging said rest such that the door is supported above a support surface at a height being accessible to a user, the door being rotatable such that the user may easily paint each side of the door; and a carrying member having a pair of spaced longitudinal arms, said spaced longitudinal arms being spaced such that bottom ends of said spaced longitudinal arms are selectively received in said square area and said concavely arcuate area such that said rod is supported by said carrying member.

2. The assembly according to claim 1, wherein said rod having a first end and a second end, said rod being elongated, said concavely arcuate area of said rod being positioned proximate said second end of said rod.

3. The assembly according to claim 1, wherein said outer surface of said rod having a square area such that each of four sides of said square area are recessed inwardly from said outer surface of said rod, said square area of said rod being positioned proximate said first end of said rod.

4. The assembly according to claim 1, wherein each of said pair of brackets having a primary end and a secondary end, each of said pair of brackets being elongated, said pair of brackets each having a bend thereon such that each of said pair of brackets is L-shaped.

5. The assembly according to claim 1, wherein an outside surface of a coupled portion of said pair of brackets being coupled to opposite sides of said outer surface of said rod such that a bend on each of said pair of brackets is positioned adjacent to a first end of said rod, an engaging portion of each of said pair of brackets extending laterally away from said rod.

6. The assembly according to claim 1, wherein an engaging portion of each of said brackets having a pair of fastener apertures extending through a front side and a back side of said engaging portion of each of said pair of brackets, said mount being positionable on the door such that said back side of said engaging portion of said pair of brackets coextensively abuts an end of the door.

7. The assembly according to claim 1, wherein said mount being one of a pair of said mounts, each of said pair of mounts being coupled to an associated one of a top end and a bottom end of the door such that said pair of mounts is each centrally positioned on the door.

8. The assembly according to claim 1, wherein said rest having an outermost edge extending between a front side and a back side of said rest.

9. The assembly according to claim 1, wherein a retainer coupled to and extending forwardly from a front side of said rest such that said retainer extends between a first lateral side and a second lateral side of an outermost edge of said rest, said retainer being positioned closer to a top side than a bottom side of said outermost edge of said rest.

10. The assembly according to claim 1, wherein a top side of an outermost edge of said rest having a first groove extending downwardly thereon.

11. The assembly according to claim 10, wherein a bounding surface of said first groove defining a semi-circular shape, said first groove being centrally positioned on said top side of said outermost edge of said rest.

12. The assembly according to claim 1, wherein a forward edge of a retainer having a second groove extending rearwardly thereon.

13. The assembly according to claim 12, wherein a defining surface of said second groove defining a square shape, said second groove being centrally positioned on said forward edge of said retainer.

14. The assembly according to claim 1, wherein said rest being one of a pair of said rests, each of said pair of rests being coupled to a topmost arm of an associated one of a pair of the supporting structures such that a bottom surface of a retainer on each of said pair of rests abuts an uppermost surface of the topmost arm of the associated one of the pair of supporting structures, a top side of an outermost edge of said pair of rests each being positioned upwardly from the topmost arm of the associated one of the pair of supporting structures.

15. The assembly according to claim 1, wherein a pair of the supporting structures being spaced apart, the door being positionable between the pair of supporting structures such that said concavely arcuate area of each of a pair of said rods engages a first groove in each of a pair of said rests such that the door is rotatably coupled between the pair of supporting structures.

16. A door painting assembly for rotatably mounting the door to a support, said assembly comprising:

a mount operationally coupled to the door, said mount comprising;

a rod having a first end and a second end, said rod being elongated, an outer surface of said rod having a concavely arcuate area, said concavely arcuate area of said rod being positioned proximate said second end of said rod, said outer surface of said rod having a square area such that each of four sides of said square area are recessed inwardly from said outer surface of said rod, said square area of said rod being positioned proximate said first end of said rod;

a pair of brackets each having a primary end and a secondary end, each of said pair of brackets being elongated, said pair of brackets each having a bend thereon such that each of said pair of brackets is L-shaped, an outside surface of a coupled portion of said pair of brackets each being coupled to opposite sides of said outer surface of said rod such that said bend on each of said pair of brackets is positioned adjacent to said first end of said rod, an engaging portion of each of said pair of brackets extending laterally away from said rod, said engaging portion of each of said brackets having a pair of fastener apertures extending through a front side and a back side of said engaging portion of each of said pair of brackets;

said mount being positionable on the door such that said back side of said engaging portion of said pair of brackets coextensively abuts an end of the door having said rod extending laterally away from the door;

said mount being one of a pair of said mounts, each of said pair of mounts being coupled to an associated one of a top end and a bottom end of the door such that said pair of mounts is each centrally positioned on the door;

a rest having an outermost edge extending between a front side and a back side of said rest, a top side of said outermost edge of said rest having a first groove extending downwardly thereon, a bounding surface of said first groove defining a semi-circular shape, said first groove being centrally positioned on said top side of said outermost edge of said rest;

a retainer coupled to and extending forwardly from said front side of said rest such that said retainer extends between a first lateral side and a second lateral side of said outermost edge of said rest, said retainer being positioned closer to said top side than a bottom side of said outermost edge of said rest, a forward edge of said retainer having a second groove extending rearwardly thereon, a defining surface of said second groove defining a square shape, said second groove being centrally positioned on said forward edge of said retainer;

said rest being one of a pair of said rests, each of said pair of rests being coupled to a topmost arm of an associated one of a pair of the supporting structures such that a bottom surface of said retainer on each of said pair of rests abuts an uppermost surface of the topmost arm of the associated one of the pair of supporting structures, said top side of said outermost edge of said pair of rests each being positioned upwardly from the topmost arm of the associated one of the pair of supporting structures; and the pair of supporting structures being spaced apart, the door being positionable between the pair of supporting structures such that said concavely arcuate area on each of said pair rods engages said first groove in each of said pair of rests such that the door is rotatably coupled between the pair of supporting structures, the door being supported above a support surface at a height being accessible to a user, the door being rotatable such that the user may easily paint each side of the door.

* * * * *